US009404233B2

(12) United States Patent
Jones et al.

(10) Patent No.: US 9,404,233 B2
(45) Date of Patent: Aug. 2, 2016

(54) STABILIZED AND REINFORCED CIVIL CONSTRUCTIONS AND METHOD OF MAKING SAME

(71) Applicant: Nicolon Corporation, Pendergrass, GA (US)

(72) Inventors: David Michael Jones, Dacula, GA (US); Kevin Nelson King, Alto, GA (US)

(73) Assignee: NICOLON CORPORATION, Pendergrass, GA (US)

( * ) Notice: Subject to any disclaimer, the term of this patent is extended or adjusted under 35 U.S.C. 154(b) by 122 days.

(21) Appl. No.: 14/186,306

(22) Filed: Feb. 21, 2014

(65) Prior Publication Data

US 2014/0241817 A1 Aug. 28, 2014

Related U.S. Application Data

(60) Provisional application No. 61/767,981, filed on Feb. 22, 2013.

(51) Int. Cl.

| | |
|---|---|
| ***D03D 1/00*** | (2006.01) |
| ***E02D 3/00*** | (2006.01) |
| ***D03D 25/00*** | (2006.01) |

(Continued)

(52) U.S. Cl.

CPC *E02D 3/005* (2013.01); *D03D 9/00* (2013.01); *D03D 13/00* (2013.01); *D03D 13/008* (2013.01); *D03D 15/00* (2013.01); *D03D 25/00* (2013.01); *D10B 2321/022* (2013.01); *D10B 2505/204* (2013.01); *Y10T 442/3179* (2015.04)

(58) Field of Classification Search

USPC ..... 405/302.4, 302.6, 302.7; 442/1, 181, 442/185, 186, 189

See application file for complete search history.

(56) References Cited

U.S. PATENT DOCUMENTS

| | | | |
|---|---|---|---|
| 5,108,224 | A | 4/1992 | Cabaniss et al. |
| 5,735,640 | A | 4/1998 | Meyer et al. |

(Continued)

FOREIGN PATENT DOCUMENTS

| | | |
|---|---|---|
| CN | 201581191 | 9/2010 |
| CN | 201581191 U | 9/2010 |

(Continued)

OTHER PUBLICATIONS

Designation: D1238-13; Standard Test Method for Melt Flow Rates of Thermoplastics by Extrusion Plastometer; p. 1-16; Retrieved on Jan. 30, 2014.

Designation: D1505-10; "Standard Test Method for Density of Plastics by the Density-Gradient Technique"; ASTM International; p. 1-7; retreived on Feb. 14, 2014.

Designation: D4491-99a; "Standard Test Method for Water Permeability of Geotextiles by Permittivity"; ASTM International; p. 1-6; Dec. 10, 1999.

(Continued)

*Primary Examiner* — Sean Andrish

(74) *Attorney, Agent, or Firm* — Cantor Colburn LLP

(57) ABSTRACT

Described herein is woven geotextile formed of a plain six-pick weave fabric having an apparent opening size (AOS) of at least 40 as measured in accordance with ASTM International Standard D4751, a water flow rate of at least 35 gpm/ft$^2$ as measured in accordance with ASTM International Standard D4491, a 12% strain at a tensile load of at least 300 lb/in as measured in accordance with ASTM International Standard D4595 in the warp direction, and a 12% strain at a tensile load of at least 270 lb/in in accordance with ASTM International D4595 at 270 lb/in in the fill direction. Also described herein is a reinforced civil structure having a subgrade formed at least partially of soil; a base course; and a woven geotextile disposed between the subgrade and the base course.

77 Claims, 10 Drawing Sheets

(51) Int. Cl.

| | |
|---|---|
| ***D03D 9/00*** | (2006.01) |
| ***D03D 13/00*** | (2006.01) |
| ***D03D 15/00*** | (2006.01) |

(56) References Cited

U.S. PATENT DOCUMENTS

| | | | | |
|---|---|---|---|---|
| 2004/0176007 | A1* | 9/2004 | Braekevelt | 442/229 |
| 2009/0195124 | A1* | 8/2009 | Abramovich et al. | 310/339 |
| 2011/0250448 | A1 | 10/2011 | Jones et al. | |
| 2011/0250809 | A1 | 10/2011 | King et al. | |

FOREIGN PATENT DOCUMENTS

| | | |
|---|---|---|
| KR | 101193150 | 10/2012 |
| KR | 101193150 B1 | 10/2012 |

OTHER PUBLICATIONS

Designation: D4595-11; "Standard Test Method for Tensile Properties of Geotextiles by the Wide-Width Strip Method"; ASTM International; p. 1-13; Oct. 1, 2011.

Designation: D4751-12; "Standard Test Method for Determining Apparent Opening Size of a Geotextile"; ASTM International; p. 1-7; Jul. 1, 2012.

Designation: D6767-11; "Standard Test Method for Pore Size Characteristics of Geotextiles by Capillary Flow Test"; p. 1-6; Feb. 1, 2011.

International Search Report; International Application No. PCT/US2014/017732; International Filing Date: Feb. 21, 2014; Date of Mailing: Apr. 23, 2014; 4 pages.

Written Opinion of International Searching Authority; International Application No. PCT/US2014/017732; International Filing Date: Feb. 21, 2014; Date of Mailing: Apr. 23, 2014; 6 pages.

* cited by examiner

STABILIZED AND REINFORCED CIVIL CONSTRUCTIONS AND METHOD OF MAKING SAME

CROSS-REFERENCE TO RELATED APPLICATION

This application claims benefit of U.S. Provisional Patent Application Ser. No. 61/767,981, filed Feb. 22, 2013, which is incorporated herein in its entirety by reference.

TECHNICAL FIELD

The instant invention generally is related to geotextiles. More specifically the instant invention is related to a geosynthetic fabric having high water flow and small particle retention capabilities and application thereof in civil constructions.

BACKGROUND OF THE INVENTION

Various geotextiles are employed in erosion control, turf reinforcement, and civil constructions involving earth reinforcement. Geotextiles employed in earth reinforcement of level and graded structures, e.g. roadways or runways, and foundations typically have more biaxial geotextile tensile and/or shear strength properties than those geotextiles employed in erosion control and turf reinforcement. In addition, geotextiles used in earth reinforcement applications have more symmetrical tensile and/or shear strength properties than earth reinforcement materials employed in retaining wall structures and steep grades. These more level, more biaxial, and less aggressive environments accordingly place a premium on geotextiles which perform acceptably from a subgrade stabilization and base course reinforcement point of view, but which can be manufactured and supplied efficiently and inexpensively, and which can be rolled, stored, shipped, and installed easily.

Subgrade stabilization is often required when weak subgrade conditions exist. For subgrade stabilization, a geotextile is generally placed directly on top of a weak subgrade. The geotextile provides separation between an aggregate base course above and the subgrade below; improves bearing capacity; enables, potentially, a reduction in base course thickness; allows increased traffic; and reduces permanent deformation within a surface or pavement system placed on top of base courses. Separation, reinforcement, and filtration properties are relevant when considering geotextiles for subgrade stabilization applications.

Separation geotextiles minimize aggregate penetration into the underlying subgrade by the action of applied loads and subsequent migration of the subgrade upwardly into the base course. For example, it is known that an intermixing of as little as 10 to 20 percent of subgrade fines into the base course can severely damage base course strength. By employing a separation geotextile, contamination of a granular and/or aggregate base course by subgrade fines is effectively reduced, thereby preventing strength damage. Moreover, the presence of the separation geotextile can result in the thickness of the base course being reduced from that which otherwise would be necessary in the absence of the geotextile.

In addition, the disposition of a geotextile over the subgrade can significantly reduce the potential mode of failure and improve bearing capacity. The geotextile aides in the prevention of the granular and/or aggregate base course from punching into the soft foundation soils under direct applied loads, such as from wheel or truck loads. Absent the protection of the geotextile, base punching, or localized shear failure, can result in a general shear failure. The geotextile provides the subgrade an opportunity to develop its ultimate bearing capacity.

Soil deformation is directly related to the presence of a weak subgrade. As deformation of the soil occurs, large scale tension develops in the geotextile. Accordingly, the geotextile should provide tensioned-membrane support. The stress conditions in the base course under load are analogous to a loaded beam. Due to bending, the base experiences compression at the top and tension at the base under the load. The cohesionless base course material has no tensile resistance and generally relies on the subgrade to provide lateral restraint. Weak subgrades provide very little lateral restraint; thus, the aggregate at the bottom of the base course tends to move apart, allowing intrusion of the soft subgrade. By positioning a geotextile at the bottom of the base course, the geotextile restrains aggregate movement by providing tensile strength. The net effect is a change in the magnitude of stress imposed on the subgrade, a reduction directly under the loaded area and an increase outside the loaded area. This spreading of the stresses over a larger area improves the load carrying capability of the civil structure (e.g. a road). A geotextile possessing a high modulus can provide more load spreading ability for the same rut depth. Reinforcement through tensioned-membrane support is, therefore, provided through the geotextile's load-strain characteristics and soil/geotextile frictional interaction.

Yet, water flow rate and soil retention are at odds with conventional fabric strength. Typically, to increase strength, the pores of the fabric are reduced. As a result, the fabric is limited to the amount of water that can pass through the fabric and, as a result, the size of the soil particulates it can retain. If higher flow rates and larger particle size retention are desired, the fabric must yield on strength due to lower fabric density. Accordingly, there is a need for a woven geosynthetic fabric which has improved strength for reinforcement while maintaining relatively high flow rates and particle retention. It is to solving this and other needs the present invention is directed.

SUMMARY OF THE INVENTION

The present invention is directed to a woven geotextile comprising a plain six-pick weave fabric. The fabric has an apparent opening size (AOS) of at least 40 as measured in accordance with American Society for Testing and Materials International (ASTM International) Standard D4751-12, a water flow rate of at least 35 gallons/minute·ft$^2$ (gpm/ft$^2$) as measured in accordance with ASTM International Standard D4491-99a (Reapproved 2009), and a 12% strain at a tensile load of at least 300 lb/in as measured in accordance with ASTM International Standard D4595-11 in a warp direction. In one aspect, the fabric comprises:

i. a plurality of fill sets extending in a fill direction, each fill set having six fill yarns positioned substantially side-by-side one another;

ii. a plurality of warp yarns extending in the warp direction and interweaving the plurality of fill sets; and iii. a plurality of openings dispersed across the fabric, each opening defined by a given fill set and two adjacent warp yarns respectively disposed on opposite sides of and interweaving the given fill set and the intersection of the two adjacent warp yarns. In one aspect, the openings are substantially triangularly-shaped. In another aspect, the fabric has a water flow rate of at least 70 gpm/ft$^2$ as measured in accordance with ASTM International Standard D4491-99a (Reapproved 2009).

In another aspect, the fabric is a 1/6 plain weave fabric. Still, in another aspect, the fabric is a 2/6 plain weave fabric. For the 2/6 plain weave fabric, the plurality of warp yarns are disposed as warp sets and each warp set has two warp yarns positioned substantially side-by-side; and each opening is defined by a given fill set and two adjacent warp sets respectively disposed on opposite sides of and interweaving the given fill set and the intersection of the two adjacent warp sets.

The warp yarns of the fabric comprise 1000 denier, oval monofilaments comprising an admixture of polypropylene and a polypropylene/ethylene copolymer and having a tenacity of at least 0.75 g/denier at 1% strain, at least 1.5 g/denier at 2% strain, and at least 3.75 g/denier at 5% strain. Further, the fabric can employ fill yarns comprising 565 denier, round polypropylene monofilaments. In another aspect, the fabric can employ fill yarns comprising an admixture of polypropylene and a polypropylene/ethylene copolymer and having a tenacity of at least 0.75 g/denier at 1% strain, at least 1.5 g/denier at 2% strain, and at least 3.75 g/denier at 5% strain.

The present invention is also directed to a reinforced civil structure. The civil structure comprises a subgrade formed at least partially of soil; a base course formed at least partially of a granular material, aggregate material, or a combination thereof; and the geotextile comprising the plain six-pick weave fabric disposed between the subgrade and the base course. Further, the civil structure can further comprise a surface layer disposed on the base course. In one aspect, the surface layer comprises concrete. In another aspect, the surface layer comprises asphalt. Yet, in another aspect, the civil structure further comprises a concrete layer disposed on the base course and an asphalt layer disposed on the concrete layer.

It is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods, and systems for carrying out the present invention. It is important, therefore, that the claims be regarded as including such equivalent constructions insofar as they do not depart from the spirit and scope of the present invention.

Other advantages and capabilities of the present invention will become apparent from the following description taken in conjunction with the accompanying drawings showing the elements and the various aspects of the present invention.

DETAILED DESCRIPTION OF THE INVENTION

Figure 1:
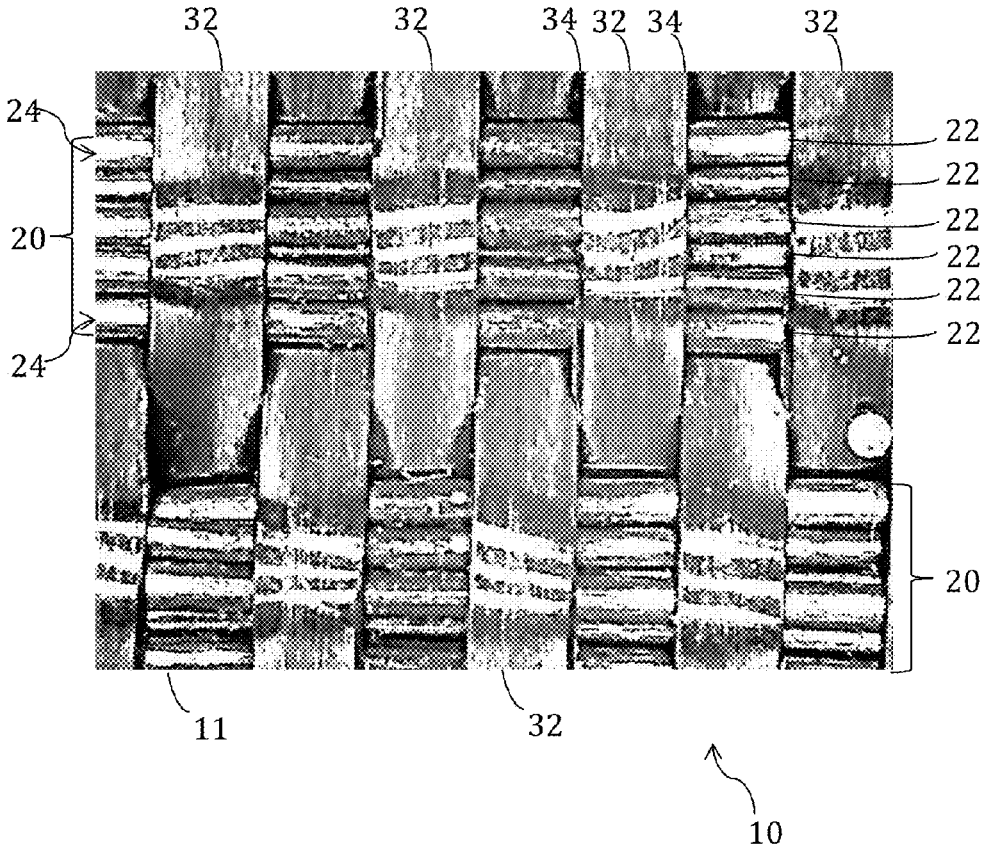
FIG. 1 is a top view of a 1/6 plain six-pick weave fabric in accordance with the present invention.

The present invention is directed to geotextile comprising a plain six-pick weave fabric. Such fabric can be used in soil reinforcement applications in civil constructions, such as an unpaved or paved road, runways, building foundations, etc.

For a fuller understanding of this disclosure and the invention described therein, reference should be made to the above and the following detailed description taken in connection with the accompanying figures. When reference is made to the figures, like reference numerals designate corresponding parts throughout the several figures.

Referring to FIGS. 1-4, a woven geotextile 10 comprising a plain weave six-pick fabric 11 is illustrated. The fabric 11 has an apparent opening size (AOS) of at least 40 as measured in accordance with ASTM International Standard D4751-12, a water flow rate of at least 35 gpm/ft$^2$ as measured in accordance with ASTM International Standard D4491-99a (Reapproved 2009), and a 12% strain at a tensile load of at least 300 lb/in as measured in accordance with ASTM International Standard D4595-11 in the warp direction.

The fabric comprises:

i. a plurality of fill sets 20 extending in a fill direction, each fill set having six fill yarns 22 positioned substantially side-by-side one another;

ii. a plurality of warp yarns 32 extending in a warp direction and interweaving the plurality of fill sets 20; and iii. a plurality of openings 40 dispersed across the fabric 11, each opening 40 defined by a given fill set 20 and two adjacent warp yarns 32 respectively disposed on opposite sides of and interweaving the given fill set 20 and the intersection of the two adjacent warp yarns 32. The fill yarns 22 of the respective fill sets 20 are substantially aligned in the same plane.

Figure 2:
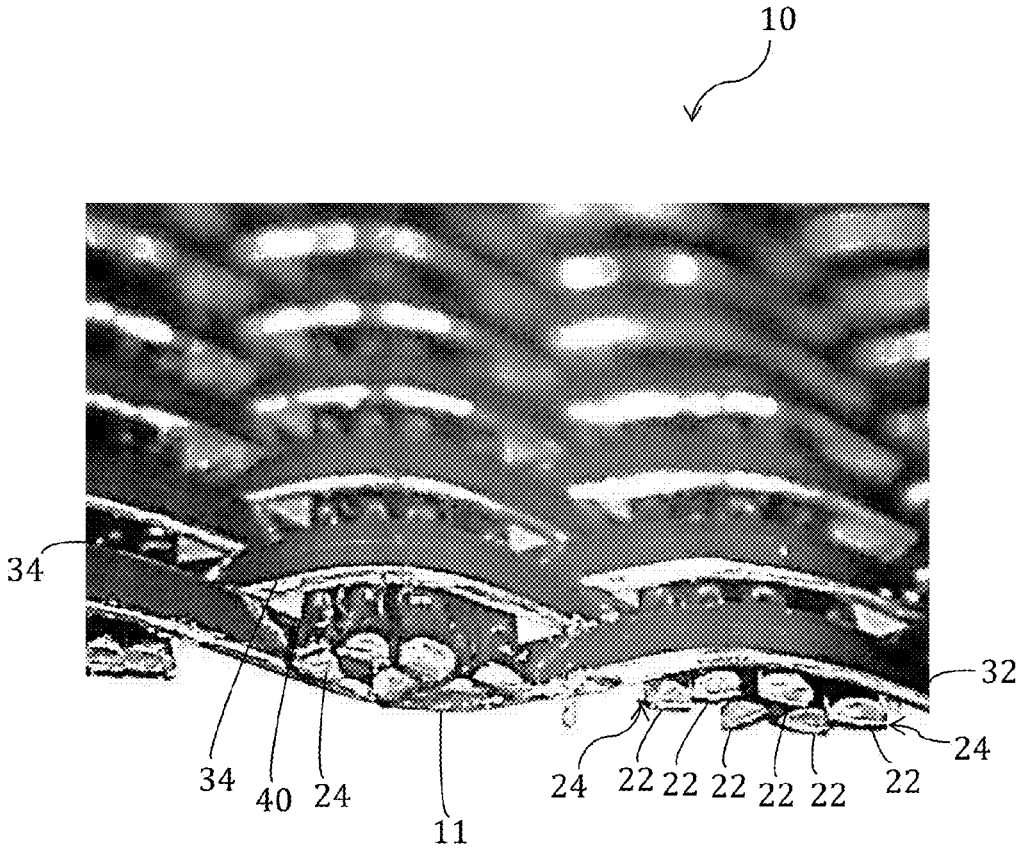
FIG. 2 is a perspective view of the fabric of FIG. 1.

Each fill set 20 has outermost fill yarns 24 on the opposite sides of the six member set. Each warp yarn has warp yarn edges 34 on the narrow sides of the warp yarn 32. As illustrated in FIG. 2, respective openings 40 are disposed between a given outermost fill yarn 24, the warp yarn edge 34 of one warp yarn 32 which is positioned to one side of the given fill set 20, and the warp yarn edge 34 of an adjacent warp yarn 32 position on the other side of the given fill set 20. Thus, a respective opening 40 is defined by a given fill set 20 and two adjacent warp yarns 32 respectively disposed on opposite sides of and interweaving the given fill set 20 and the intersection of the two adjacent warp yarns 32.

The fabric 11 shown in FIGS. 1 and 2 is a 1/6 plain six-pick weave. Characteristically, the openings 40 of the 1/6 plain six-pick weave fabric 11 are substantially triangularly-shaped.

Figure 3:
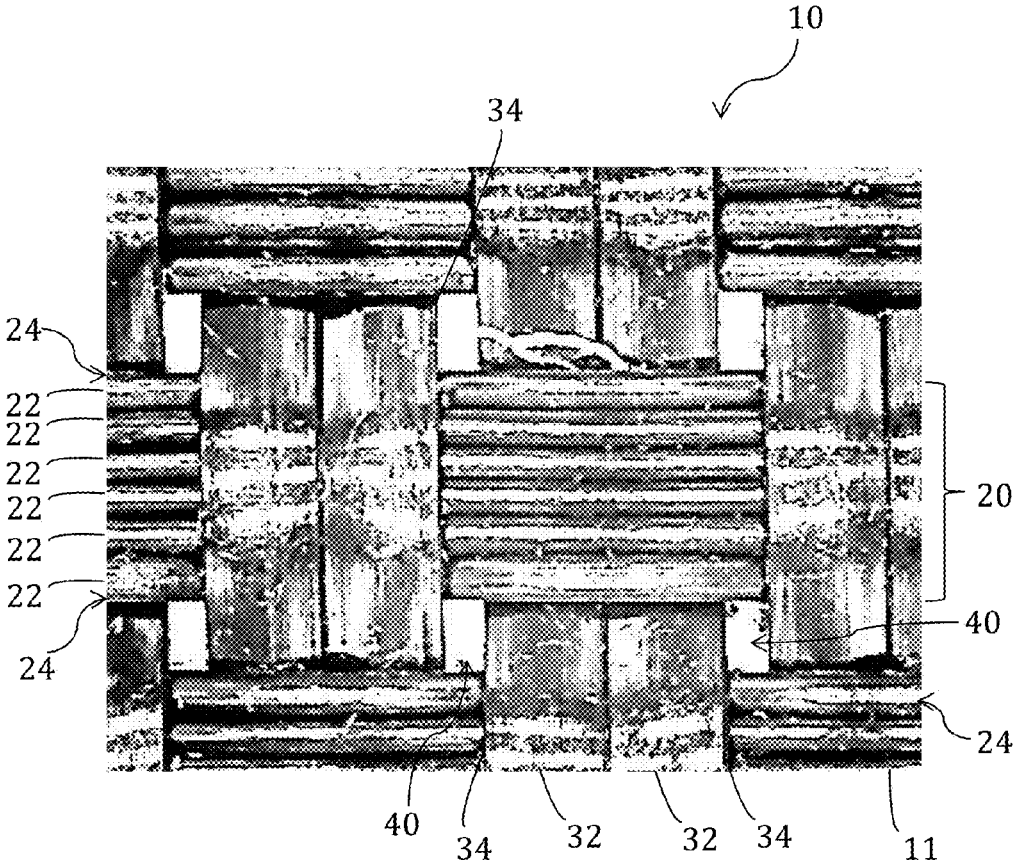
FIG. 3 is a top view of a 2/6 plain six-pick weave fabric in accordance with the present invention.
Figure 4:
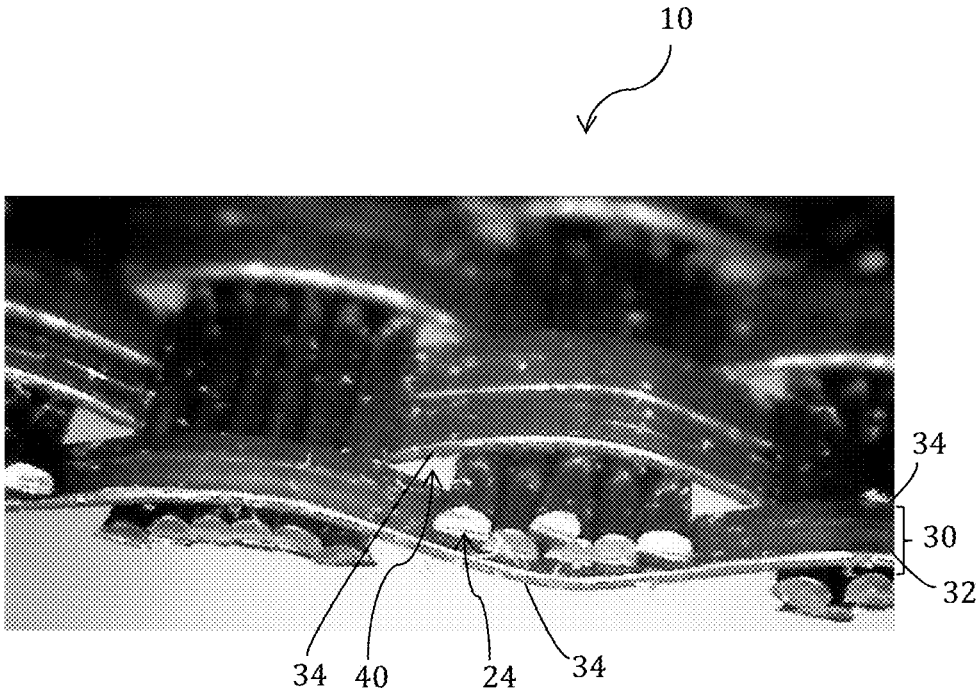
FIG. 4 is a perspective view of the fabric of FIG. 3.

Referring to FIGS. 3 and 4, the illustrated fabric 11 is a 2/6 plain six-pick weave. The 2/6 plain six-pick weave has the plurality of warp yarns 32 disposed as warp sets 30; and each warp set 30 has two warp yarns 32. Each warp set 30 has two warp yarns 32 positioned substantially side-by-side. In addition, each opening 40 is defined by a given fill set 20 and two adjacent warp sets 30 respectively disposed on opposite sides of and interweaving the given fill set 20 and the intersection of the two adjacent warp sets 30.

As indicated above, the fabric 11 has excellent water flow characteristics of at least 35 gallons/minute·ft$^2$ (gpm/ft$^2$) as measured in accordance with ASTM International Standard D4751-12. In another aspect, the fabric 11 has a water flow rate of at least 40 gpm/ft$^2$ as measured in accordance with ASTM International Standard D4751-12. Yet, in another aspect, the fabric 11 has a water flow rate of at least 45 gpm/ft$^2$ as measured in accordance with ASTM International Standard D4751-12. Still, in another aspect, the fabric 11 has a water flow rate of at least 50 gpm/ft$^2$ as measured in accordance with ASTM International Standard D4751-12. Further, in another aspect, the fabric 11 has a water flow rate of at least 55 gpm/ft$^2$ as measured in accordance with ASTM International Standard D4751-12. Still further, in another aspect, the fabric 11 has a water flow rate of at least 60 gpm/ft$^2$ as measured in accordance with ASTM International Standard D4751-12. Yet further, in another aspect, the fabric 11 has a water flow rate of at least 65 gpm/ft$^2$ as measured in accordance with ASTM International Standard D4751-12. Yet still, in another aspect, the fabric 11 has a water flow rate of at least 70 gpm/ft$^2$ as measured in accordance with ASTM International Standard D4751-12. In another aspect, the fabric 11 has a water flow rate of at least about or in any range between about 40, 42, 45, 47, 50, 52, 55, 57, 60, 62, 65, 67, and 70 gpm/ft$^2$ as measured in accordance with ASTM International Standard D4751-12.

Also indicated above, the fabric 11 has excellent warp strength characteristics demonstrated by a 12% strain at a tensile load of at least 300 lb/in as measured in accordance with ASTM International Standard D4595-11 in the warp direction. In another aspect, the fabric 11 has a 12% strain at a tensile load of at least 310 lb/in. as measured in accordance with ASTM International Standard D4595-11 in the warp direction. Still, in another aspect, the fabric 11 has a 12% strain at a tensile load of at least 320 lb/in. as measured in accordance with ASTM International Standard D4595-11 in the warp direction. Yet, in another aspect, the fabric 11 has a 12% strain at a tensile load of at least 325 lb/in. as measured in accordance with ASTM International Standard D4595-11 in the warp direction. Further, in another aspect, the fabric 11 has a 12% strain at a tensile load of at least 330 lb/in. as measured in accordance with ASTM International Standard D4595-11 in the warp direction. Still further, in another aspect, the fabric 11 has a 12% strain at a tensile load of at least 340 lb/in in the warp direction. Yet further, in another aspect, the fabric 11 has a 12% strain at a tensile load of at least 345 lb/in. as measured in accordance with ASTM International Standard D4595-11 in the warp direction. Yet still, in another aspect, the fabric 11 has a 12% strain at a tensile load of at least 350 lb/in. as measured in accordance with ASTM International Standard D4595-11 in the warp direction. In another aspect, the fabric 11 has a 12% strain at a tensile load of at least about or in any range between about 300, 302, 305, 307, 310, 312, 315, 317, 320, 322, 325, 327, 330, 332, 335, 337, 340, 342, 345, 347, and 350 lb/in as measured in accordance with ASTM International Standard D4595-11 in the warp direction.

Furthermore, the fabric 11 has a 12% strain at a tensile load of at least 270 lb/in as measured in accordance with ASTM International Standard D4595-11 in the fill direction. In another aspect, the fabric 11 has a 12% strain at a tensile load of at least 280 lb/in. as measured in accordance with ASTM International Standard D4595-11 in the fill direction. Still, in another aspect, the fabric 11 has a 12% strain at a tensile load of at least 290 lb/in. as measured in accordance with ASTM International Standard D4595-11 in the fill direction. Yet, in another aspect, the fabric 11 has a 12% strain at a tensile load of at least 300 lb/in. as measured in accordance with ASTM International Standard D4595-11 in the fill direction. Further, in another aspect, the fabric 11 has a 12% strain at a tensile load of at least 310 lb/in. as measured in accordance with ASTM International Standard D4595-11 in the fill direction. Still further, in another aspect, the fabric 11 has a 12% strain at a tensile load of at least 320 lb/in in the fill direction. Yet further, in another aspect, the fabric 11 has a 12% strain at a tensile load of at least 330 lb/in. as measured in accordance with ASTM International Standard D4595-11 in the fill direction. In another aspect, the fabric 11 has a 12% strain at a tensile load of at least 334 lb/in. as measured in accordance with ASTM International Standard D4595-11 in the fill direction. Yet still, in another aspect, the fabric 11 has a 12% strain at a tensile load of at least 350 lb/in. as measured in accordance with ASTM International Standard D4595-11 in the fill direction. In another aspect, the fabric 11 has a 12% strain at a tensile load of at least about or in any range between about 270, 272, 275, 277, 280, 282, 285, 287, 290, 292, 295, 297, 300, 302, 305, 307, 310, 312, 315, 317, 320, 322, 325, 327, 330, 333, 335, 337, 340, 342, 345, 347, and 350 lb/in as measured in accordance with ASTM International Standard D4595-11 in the fill direction.

Typically, but not required, the fill yarns 22 are polypropylene monofilaments. In another aspect, the fill yarns 22 comprise round polypropylene monofilaments or 565 denier, round polypropylene mono filaments.

Warp yarns 32 comprise monofilaments formed of an admixture of polypropylene and a polypropylene/ethylene copolymer and having a tenacity of at least 0.75 g/denier at 1% strain, at least 1.5 g/denier at 2% strain, and at least 3.75 g/denier at 5% strain. In another aspect, warp yarns 32 comprise 1000 denier, oval monofilaments comprising an admixture of polypropylene and a polypropylene/ethylene copolymer and having a tenacity of at least 0.75 g/denier at 1% strain, at least 1.5 g/denier at 2% strain, and at least 3.75 g/denier at 5% strain. Fill yarns optionally may be formed of like polypropylene/ethylene copolymer.

Figure 5:
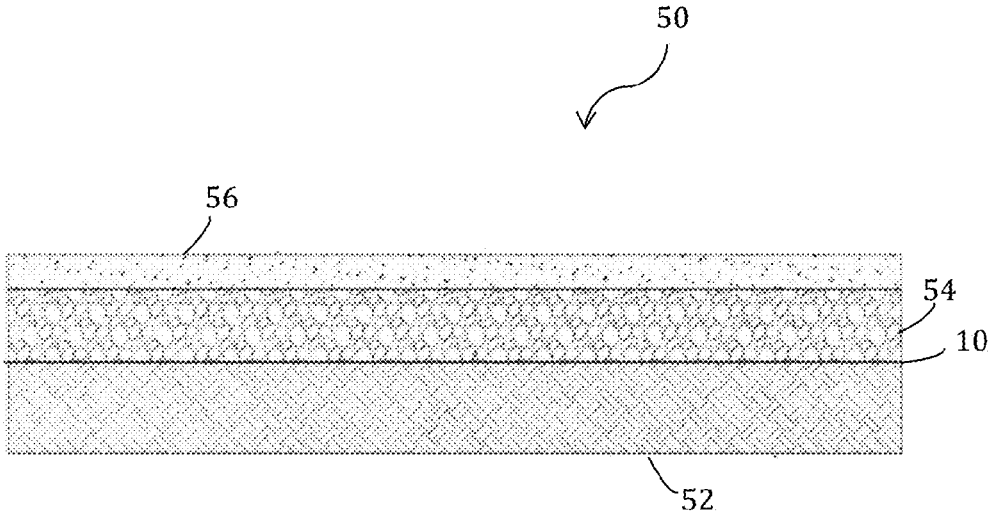
FIG. 5 is a side view of a civil construction in accordance with the present invention.

Referring to FIG. 5, a reinforced civil structure 50 comprises a subgrade 52 formed at least partially of soil; a base course 54 formed at least partially of a granular material, an aggregate material, or a combination of granular and aggregate material; and a woven geotextile 10 disposed between the subgrade 52 and the base course 54. The geotextile 10 comprises the plain six-pick weave fabric 11 having an AOS of at least 40 as measured in accordance with ASTM International Standard D4751-12, a water flow rate of at least 35 gpm/ft$^2$ as measured in accordance with ASTM International Standard D4491-99a (Reapproved 2009), and a 12% strain at a tensile load of at least 300 lb/in as measured in accordance with ASTM International Standard D4595-11 in the warp direction. The fabric 11 can be the 1/6 or 2/6 plain six-pick fabric described above. Furthermore, any of the features of the fabric 11, such as AOS, water flow rate, tensile load, weave pattern, openings 40, fill yarns 22, and/or warp yarns 32 as described above can be employed in the reinforced civil structure 50.

A woven fabric typically has two principle directions, one being the warp direction and the other being the weft direction. The weft direction is also referred to as the fill direction. The warp direction is the length wise, or machine direction of the fabric. The fill or weft direction is the direction across the fabric, from edge to edge, or the direction traversing the width of the weaving machine. Thus, the warp and fill directions are generally perpendicular to each other. The set of yarns, threads, mono filaments, films, and slit tapes running in each direction are referred to as the warp yarns and the fill yarns, respectively.

A woven fabric can be produced with varying densities. This is usually specified in terms of number of the ends per inch in each direction, warp and fill. The higher this value is, the more ends there are per inch and, thus, the fabric density is greater or higher.

The weave pattern of fabric construction is the pattern in which the warp yarns are interlaced with the fill yarns. A woven fabric is characterized by an interlacing of these yarns. For example, plain weave is characterized by a repeating pattern where each warp yarn is woven over on fill yarn and then woven under the next fill yarn.

The term "shed" is derived from the temporary separation between upper and lower warp yarns through which the fill yarns are woven during the weaving process. The shed allows the fill yarns to interlace into the warp to create the woven fabric. By separating some of the warp yarns from the others, a shuttle can carry the fill yarns through the shed, for example, perpendicularly to the warp yarns. As known in weaving, the warp yarns which are raised and the warp yarns which are lowered respectively become the lowered warp yarns and the raised warp yarns after each pass of the shuttle. During the weaving process, the shed is raised; the shuttle carries the weft yarns through the shed; the shed is closed; and the fill yarns are pressed into place. Accordingly, as used herein with respect to the woven fabric, the term "shed" means a respective fill set which is bracketed by warp yarns.

A plain six-pick weave is characterized by a repeating pattern where a warp set of one or more warp yarns is woven over one fill set of six fill yarns and then woven under the next fill set. In other words, the plain six-pick weave comprises fill sets having six fill yarns per shed. As used herein, a 1/6 plain weave is characterized by a repeating pattern where each warp yarn is woven over one fill set and then woven under the next fill set. A 1/6 plain weave is illustrated in FIGS. 1 and 2. Relatedly, a 2/6 plain weave is characterized by a repeating pattern where a warp set of 2 warp yarns aligned side-by-side are woven over one fill set and then woven under the next fill set. A 2/6 plain weave is illustrated in FIGS. 3 and 4. The fill yarns of a fill set are aligned substantially side-by-side one another and disposed in the shed in substantially the same plane when viewed in the fill or weft direction. Each fill set comprises six fill yarns of substantially the same cross-sectional shape and substantially the same diameter.

A twill weave, in contrast to the plain weave and the plain six-pick weave, has fewer interlacings in a given area. The twill is a basic type of weave, and there are a multitude of different twill weaves. A twill weave is named by the number of fill yarns which a single warp yarn goes over and then under. For example, in a 2/2 twill weave, a single warp end weaves over two fill yarns and then under two fill yarns. In a 3/1 twill weave, a single warp end weaves over three fill yarns and then under one fill yarn. For fabrics being constructed from the same type and size of yarn, with the same thread or monofilament densities, a twill weave has fewer interlacings per area than a corresponding plain weave fabric. Accordingly, a twill weave is not a plain six-pick weave.

A satin weave, also in contrast to the plain weave and the plain six-pick weave, has fewer interlacings in a given area. It is another basic type of weave from which a wide array of variations can be produced. A satin weave is named by the number of ends on which the weave pattern repeats. For example, a five harness satin weave repeats on five ends and a single warp yarn floats over four fill yarns and goes under one fill yarn. An eight harness satin weave repeats on eight ends and a single warp yarn floats over seven fill yarns and passes under one fill yarn. For fabrics being constructed from the same type of yarns with the same yarn densities, a satin weave has fewer interlacings than either a corresponding plain or twill weave fabric. Accordingly, a satin weave is not a plain six-pick weave.

The process for making fabrics, to include geotextile fabrics, is well known in the art. Thus, the weaving process employed can be performed on any conventional textile handling equipment suitable for producing the plain six-pick woven fabric. In weaving the plain six-pick woven fabric, the raised warp yarns are raised and the lowered warp yarns are lowered, respectively, by the loom to open the shed. Six yarns are attached to the shuttle and the shuttle is passed through the shed. Substantially the same tension is maintained on the six fill yarns as the shuttle passes across the given shed to avoid twisting of the fill set yarns. Once the fill set is positioned across the shed, the loom lowers the raised warp yarns into the lower warp yarn position and the lower warp yarns are raised into the raised warp yarn position. The fill set is pressed into place with the fill set being substantially planar in the shed, that is, the six fill yarns of the fill set are positioned substantially side-by-side across the shed in a substantially planar arrangement. Thereafter, the process is repeated to produce the plain six-pick woven fabric.

In the following discussion, reference is made to specific fabrics. Table 1 identifies the fabrics by AOS, waterflow, threads/inch, weave, warp yarns, and fill yarns.

TABLE 1

| Fabric properties | | | | | | |
|---|---|---|---|---|---|---|
| Fabric | AOS | Waterflow, gpm/ft$^2$ | Threads/inch | Weave | Warp Yarn,* denier | Fill Yarn, denier |
| HP770 | 30 | 15 | 45 × 14.5 | 2/4 basket | 1360 | 4600# |
| HP570 | 30 | 30 | 33 × 13 | 2/2 twill | 1360 | 4600# |
| HP270 | 30 | 50 | 24 × 9 | plain | 1000 | 3000# |
| HP565 | 40 | 2 | 30 × 13 | 2/2 basket | 1360 | 4600# |
| HP665 | 40 | 20 | 33 × 18 | 2/2 twill | 1360 | 4600# |
| HP465 | 40 | 20 | 25 × 9 | plain | 1360 | 4600# |
| HP370 | 40 | 40 | 35 × 10.5 | 2/2 twill | 1000 | 3000# |
| FW404 | 40 | 70 | 30 × 60 | 1/6 plain six-pick | 1000 | 565% |

*All warp yarns are oval polypropylene monofilaments.
#Fibrillated polypropylene tape
%Round polypropylene monofilament.

Figure 6:
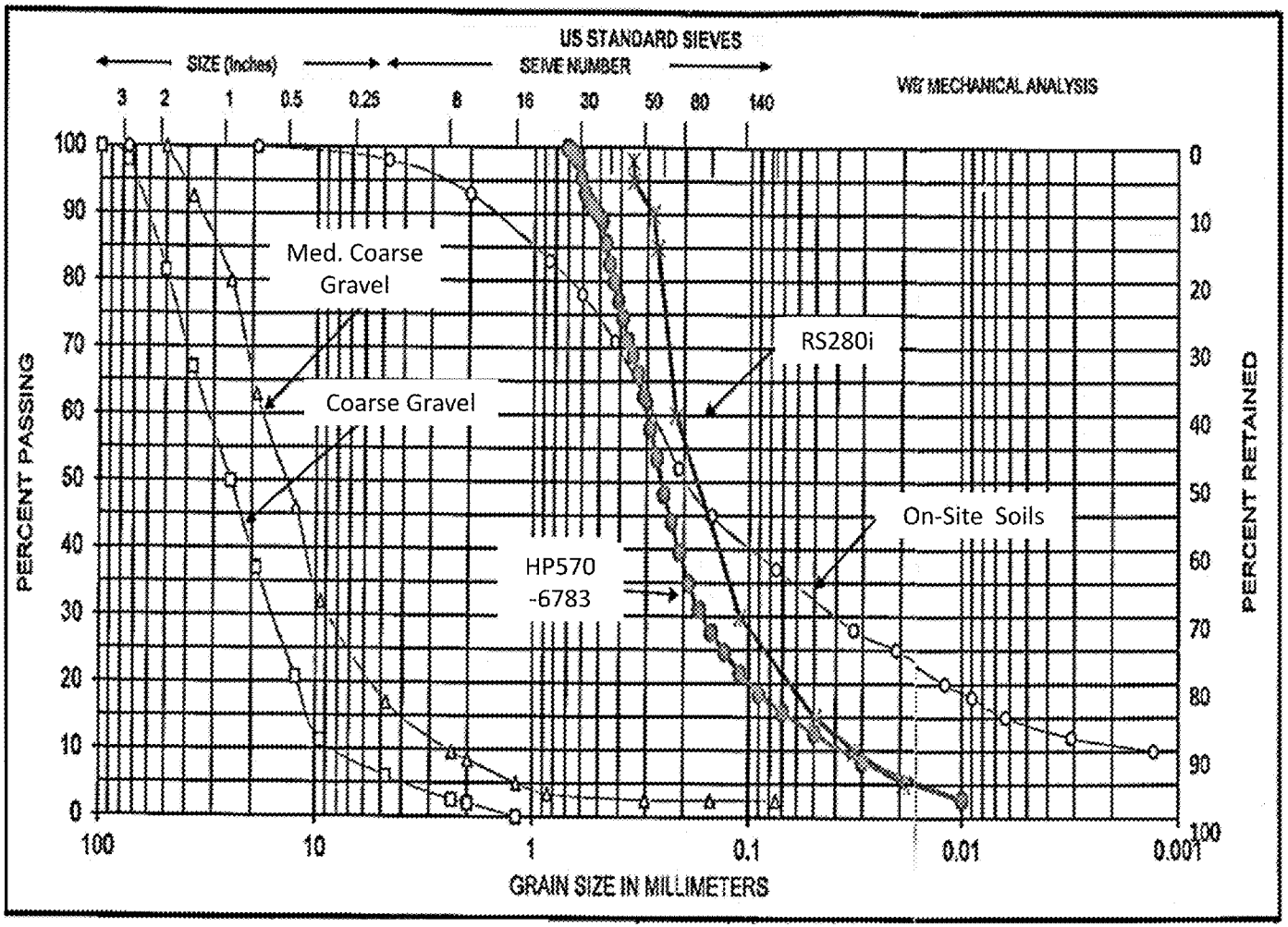
FIG. 6 is a plot reporting a porosity test of a fabric made in accordance with the present invention.

Referring to FIG. 6, AOS and pore size evaluations are reported. FIG. 6 is a grain size distribution graph and aggregate grading chart for the HP570 and RS280i fabrics. The graph provides porometer testing results with respect to various soil types. Specifically, this logarithmic graph shows cumulative percent passing of various particle sizes at various grain sizes, ranging from less than 0.01 millimeter (mm) to about 2.75 mm. As can be seen from the graph, RS280i has smaller pore sizes, i.e., a finer AOS, than HP570. AOS was measured in accordance with ASTM International D4751-12 and the results provided in FIG. 6. A pore test was performed in accordance with ASTM International D6767, and the wetting material employed was a silicone oil having a surface tension of 20.1 dynes/centimeter sold under the name SILWICK SILICON FLUID by Porous Materials Inc., Ithaca, N.Y. Two fabrics were evaluated, RS280i and HP570. RS280i was a 1/6 plain six-pick weave fabric having 30×60 threads/inch made in accordance with the present invention. Warp yarns were 565 denier round polypropylene monofilaments and fill yarns were 1000 denier oval monofilaments comprising the polypropylene and polypropylene/ethylene copolymer admixture described above. HP570 was a 2/2 twill weave having 33×13 thread/inch, 1360 denier oval polypropylene warp yarns, and 4600 denier polypropylene fibrillated tape. It was found that RS280i had an AOS of 40 as compared to an AOS of 30 for HP570.

Figure 7:
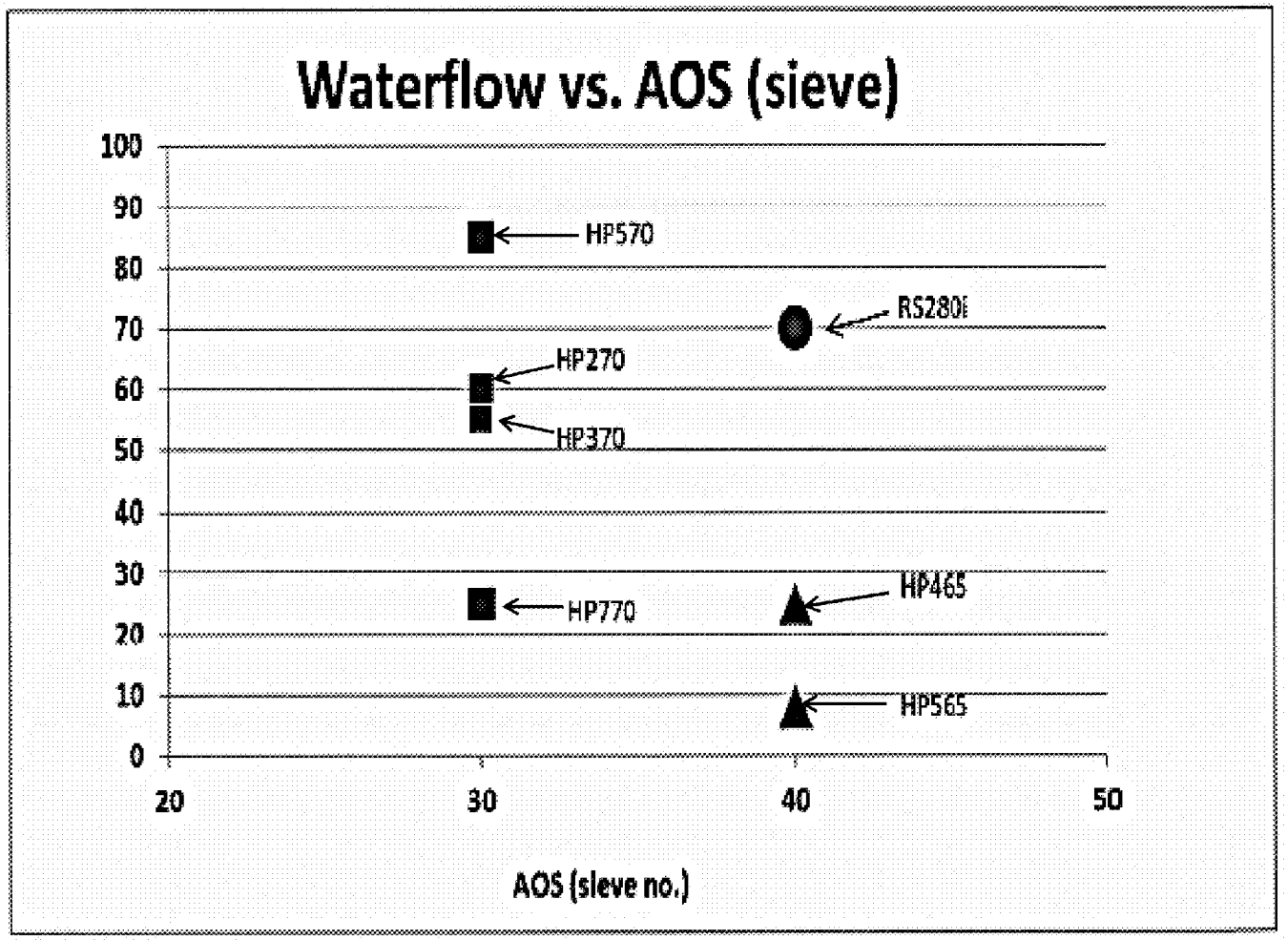
FIG. 7 is a plot of water flow (gpm/ft$^2$) with respect to Apparent Opening Size (AOS) of various fabrics.

FIG. 7 provides a comparison of water flow with respect to AOS of several fabrics listed in Table 1. RS280i is described above. RS280i had a 70 gallons/minute·ft$^2$ flow rate with a 40 AOS, while HP570 had a 30 gallons/minute flow rate with a 30 AOS. While the 1/6 plain six-pick woven fabric RS280i has a finer pore size than HP570, the plain six-pick fabric has similar water flow rate. Although not shown in FIG. 7, the 2/6 plain six-pick fabric was also tested in accordance ASTM International Standards D4751-12 and ASTM International D6767. The 2/6 fabric employed the same fill and warp yarns as RS280i and had an AOS of 40 and a water flow rate of 38 gpm/ft$^2$. Thus, the plain six-pick woven fabric provides for a high water flow rate through the fabric and provides a finer pore size for particle retention. As can be seen from FIG. 7, the 1/6 plain six-pick weave fabric provides a higher overall flow rate with a higher number of smaller pores. Thus, the higher flow rate can be achieved without decreasing AOS, unlike the conventional fabrics. In addition, FIG. 7 shows that the 1/6 plain six-pick weave fabric has superior particle retention and higher water flow rates than the conventional fabrics.

It was also found that warp crimp amplitude, i.e., the angle generated by the rise or fall of the warp yarn between adjacent fill sets, and the shape of the openings affect particle size retention. Moreover, with respect to a fabric having the same total denier or mass/area, water flow increases as the size of the fill set increases. The size of a fill set in a shed (shed size) is determined by measuring the distance across the fill set in the warp direction. Having greater water flow with an increased shed size is counter intuitive. By re-arranging the same mass/area and creating wider fill sets by simultaneous multiple fill yarn insertion into the same shed, the warp crimp amplitude and the shape of the openings can be changed. For example, with the 2/6 plain six-pick weave fabric, opening shape can be adjusted to be rectangular or square from a top view, yet have a triangular shape when viewed perspectively. This phenomenon is illustrated in FIGS. 3 and 4. As illustrated in FIGS. 1 and 2, the 1/6 plain six-pick weave fabric has openings which are triangularly shaped. Particle retention is greater with a smaller triangle and increased AOS. Yet, due to an increase in the number of openings, water flow is increased through the same area of the fabric. Opening shape and AOS can be adjusted to retain particles of a specified or desired size without sacrificing water flow characteristics due to the large number of openings per square foot of fabric. The plain six-pick weave fabric provides a product which retains finer particles with a substantial increase in water flow at a greater warp modulus. In addition, the plain six-pick woven fabric lowers warp yarn contraction and overall crimp which creates a higher modulus warp fabric. For civil engineering applications involving low California Bearing Ratio (CBR) soils, the plain six-pick weave fabric is readily employable due to its high warp modulus and high water flow when a load is delivered onto the fabric, e.g. a tractor-trailers repeatedly driving over a road during wet conditions.

Warp yarns and, optionally, fill yarns employed in the present invention are described in U.S. Patent Application Publication No. 2011/0250448 A1 by Jones et al. entitled "Polypropylene Yarn Having Increased Young's Modulus and Method of Making Same," ("Jones et al.") which is incorporated herein in its entirety by reference. Such yarns are formed of a polypropylene composition comprising a melt blended admixture of about 94 to about 95% by weight of polypropylene and about 5 to about 6% by weight of a polypropylene/ethylene copolymer. In one aspect the polypropylene/ethylene copolymer has an ethylene content of about 5% to about 20% by weight of copolymer. In another aspect, aspect the polypropylene/ethylene copolymer has an ethylene content of about 5% to about 17% by weight of copolymer. In yet another aspect, aspect the polypropylene/ethylene copolymer has an ethylene content of about 5%, about 6%, about 7%, about 8%, about 9%, about 10%, about 11%, about 12%, about 13%, about 14%, about 15%, about 16%, about 17%, about 18%, about 19%, or about 20%, or any range therebetween, by weight of copolymer. Still, in another aspect, the polypropylene/ethylene copolymer has an ethylene content of about 16% by weight of copolymer.

In another aspect, the warp yarns are formed of a polypropylene composition comprising a melt blended admixture of about 93% by weight of polypropylene, about 5% by weight of a polypropylene copolymer having an ethylene content of about 16% by weight of copolymer, and about 2 wt. % of an additive.

In one aspect, the warp yarns are formed of a polypropylene composition comprising a melt blended admixture of polypropylene and an ethylene homopolymer (polyethylene or PE) (see PE warp yarn in Table 2). Without being bound by theory, it is believed that the polyethylene acts as an anti-nucleation agent, impeding the formation of spherulites and crystals in the polypropylene and altering the process conditions. These properties widen the window to draw the resulting mixture and enable the mixture to be more easily drawn at high draw ratios. The draw ratio is a measure of the degree of stretching during the orientation of a yarn, which is expressed as the ratio of the cross-sectional area of the undrawn material to that of the drawn material. Higher draw ratios provide a stronger yarn up to a point where degradation and polymer incision occurs. Adding the polyethylene to the polypropylene in a melt blended admixture allows for drawing at high draw ratios, which provides increased modulus and tenacity. Compared to above admixture of polypropylene and the polypropylene copolymer, the polyethylene and polypropylene admixture also provides increased elongation at ultimate rupture, but the resulting modulus is substantially similar. Furthermore, the ultimate tensile values for the polypropylene/polyethylene blend are higher than the polypropylene/polypropylene copolymer blend at the same draw ratio.

Yet, in another aspect, the warp yarns are formed of a polypropylene composition comprising a melt blended admixture of about 94 to about 95% by weight of polypropylene and about 5 to about 6% by weight of a polypropylene copolymer having an ethylene content of about 16% by weight of copolymer, and having a tenacity of at least 0.75 g/denier at 1% strain, at least 1.5 g/denier at 2% strain, and at least 3.75 g/denier at 5% strain. In another aspect such yarns have a tenacity of at least 0.9 g/denier at 1% strain, at least 1.75 g/denier at 2% strain, and at least 4 g/denier at 5% strain. Still, in another aspect, such yarns have a tenacity of about 1 g/denier at 1% strain, about 1.95 g/denier at 2% strain, and about 4.6 g/denier at 5% strain.

Yet still, in another aspect, the warp yarns are formed of a polypropylene composition comprising a melt blended admixture of about 93% by weight of polypropylene, about 5% by weight of a polypropylene copolymer having an ethylene content of about 16% by weight of copolymer, and about 2 wt. % of an additive, and has a tenacity of at least 0.75 g/denier at 1% strain, at least 1.5 g/denier at 2% strain, and at least 3.75 g/denier at 5% strain. In another aspect such yarns have a tenacity of at least 0.9 g/denier at 1% strain, at least 1.75 g/denier at 2% strain, and at least 4 g/denier at 5% strain. Still, in another aspect, such yarns have a tenacity of about 1 g/denier at 1% strain, about 1.95 g/denier at 2% strain, and about 4.6 g/denier at 5% strain.

As described in Jones et al., the yarn is made by a process comprising:

a) preparing a composition comprising about 94 to about 95% by weight of polypropylene homopolymer and about 5 to about 6% by weight of a polypropylene copolymer having an ethylene content of about 16% by weight of copolymer;

b) forming the composition into a filament; and c) hot-drawing the monofilament at a temperature below the melting point of the homopolymer and at a draw ratio between 2.5:1 and 25:1 to produce the monofilament.

Still, in another aspect, the process comprises:

a) preparing a composition comprising about 93% by weight of polypropylene, about 5% by weight of a polypropylene copolymer having an ethylene content of about 16% by weight of copolymer, and about 2 wt. % of an additive;

b) forming the composition into a filament; and c) hot-drawing the monofilament at a temperature below the melting point of the homopolymer and at a draw ratio between 2.5:1 and 25:1 to produce the monofilament.

Polypropylene homopolymers employed in the warp and fill yarns can be manufactured by any known process. For example, polypropylene polymers can be prepared in the presence of Ziegler-Natta catalyst systems, based on organometallic compounds, e.g. metallocenes, and on solids containing titanium trichloride.

A polypropylene copolymer employed in warp yarns is manufactured and sold by ExxonMobil Chemical Company under the name Vistamaxx™ 6201. Vistamaxx™ 6201 is a random copolymer of propylene and ethylene, has a density of 0.862 g/cm$^3$ (ASTM International D1505), a melt mass-flow rate of 3.0 g/10 min. (230° C./2.16 kg, ASTM International D1238), and an ethylene content of about 16 weight %.

The yarns employed in the fabric of this invention can optionally include additives commonly employed with polypropylene compositions. Such additives include, but are not limited to, a colorant, a filler, a delustrant, a thermal stabilizer, an ultraviolet light absorber, an ultraviolet light stabilizer, a terminating agent, an antioxidant, a metal deactivator, a phosphite, a phosphonite, a fluorescent whitening agent, a thiosynergist, a peroxide scavenger, a nucleating agent, a plasticiser, a lubricant, an emulsifier, a rheology additive, a catalyst, a flow-control agent, an optical brightener, a flameproofing agent, an antistatic agent, a blowing agent, a benzofuranone, an indolinone, a hydrophilic agent, a hydrophobic agent, an oliophobic agent, an oliophilic agent, or any combination thereof. These conventional additives may be present in the compositions in quantities that are generally from 0.01 to 0.5 weight %, 0.01 to 1 weight %, 0.01 to 1.5 weight %, or 0.01 to 2 weight %.

The optional incorporation of such conventional ingredients into the compositions comprising polypropylene and the polypropylene and polypropylene copolymer admixture can be carried out by any known process. This incorporation can be carried out, for example, by dry blending, by extruding a mixture of the various constituents, by the conventional masterbatch technique, adding a concentrate of the additive, adding the additive such as a filler mixed in a polymeric carrier, or the like. Further information about suitable levels of additives and methods of incorporating them into polymer compositions may be found in standard reference texts.

The mechanical properties such as tenacity, tensile breaking load, elongation at break and denier of the warp yarns can be balanced by adjusting various parameters including resin formulation design (base resin, level and types of additives such as $CaCO_3$, UV stabilizers, pigment added); amount and type of ethylene copolymer used; processing equipment (quenching, slitting, drawing and annealing configuration); and processing conditions (extruder screw configuration, temperature profile and polymer throughput, stretch and annealing temperatures and profiles, line speed, etc).

Figure 8:
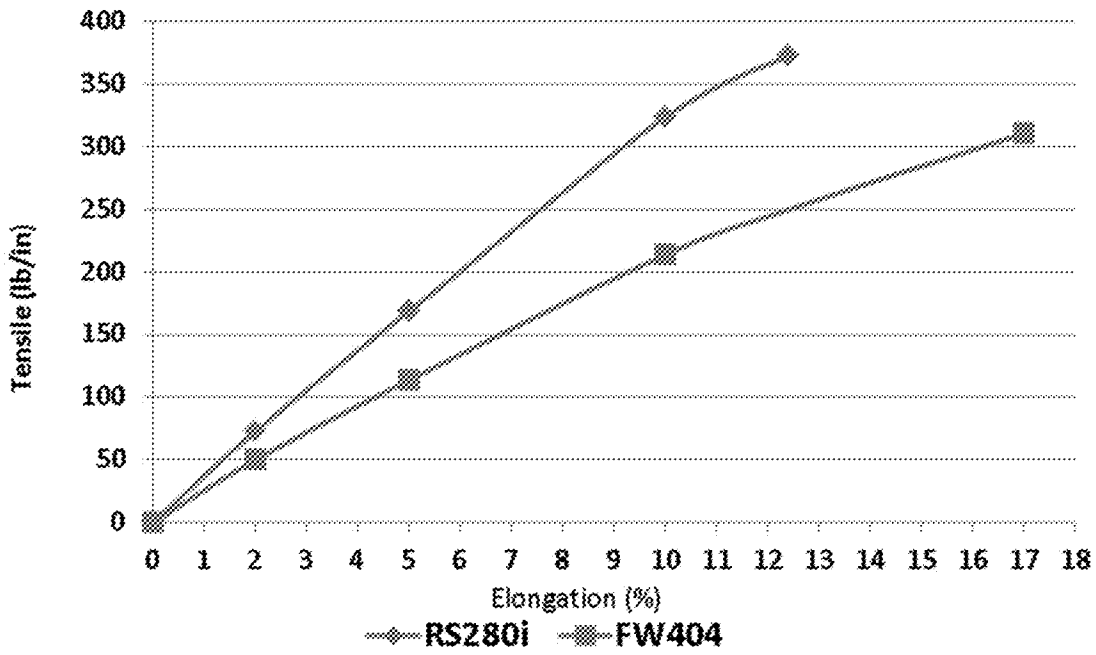
FIG. 8 is a plot comparing machine direction (MD) tensile with respect to percent elongation for the inventive fabric of six pick material using the high modulus warp yarn (RS280i) and a fabric of six pick material using standard modulus warp yarn (FW404).

Referring to FIG. 8, machine direction (MD) tensile (pounds/inch) is compared to % strain (elongation) for two fabrics, RS280i and FW404. Tensile was determined and measured in accordance with ASTM Standard D4595-11 ("Standard Test Method for Tensile Properties of Geotextile by the Wide-Strip Method"). Both fabrics are described above. FW404 employed standard modulus warp yarns (1000 denier oval polypropylene monofilament warp yarns) and 565 denier round polypropylene monofilament fill yarns. RS280i employed high modulus warp yarns (oval monofilaments formed of an admixture of 95% polypropylene homopolymer and 5% Vistamaxx™ 6201 drawn at 12:1 ratio at about 425° F. as described in Jones et al.).

Figure 9:
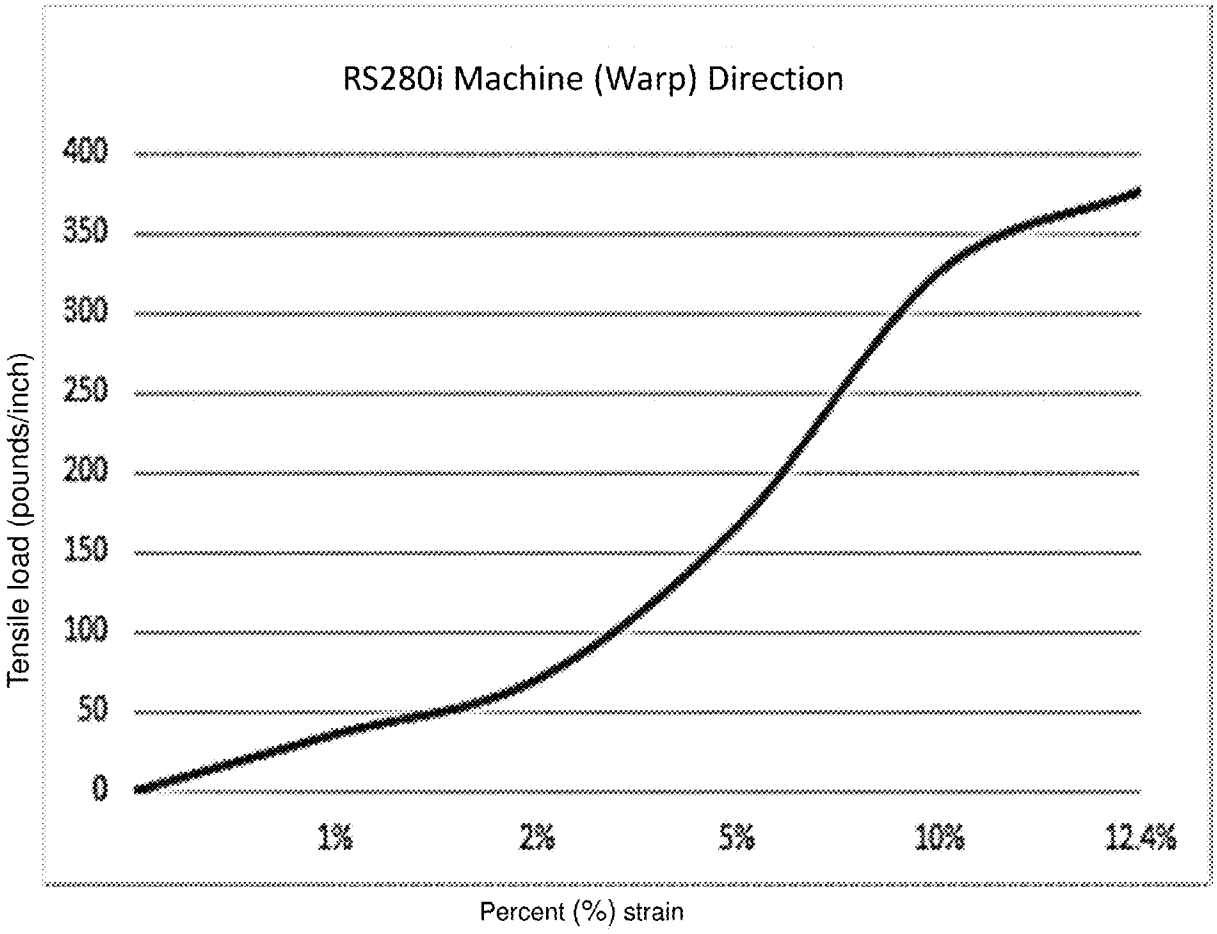
FIG. 9 is an expanded graph showing tensile load (pounds/inch) in the machine (warp) direction as a function of % strain for the RS280i fabric shown in FIG. 8.
Figure 10:
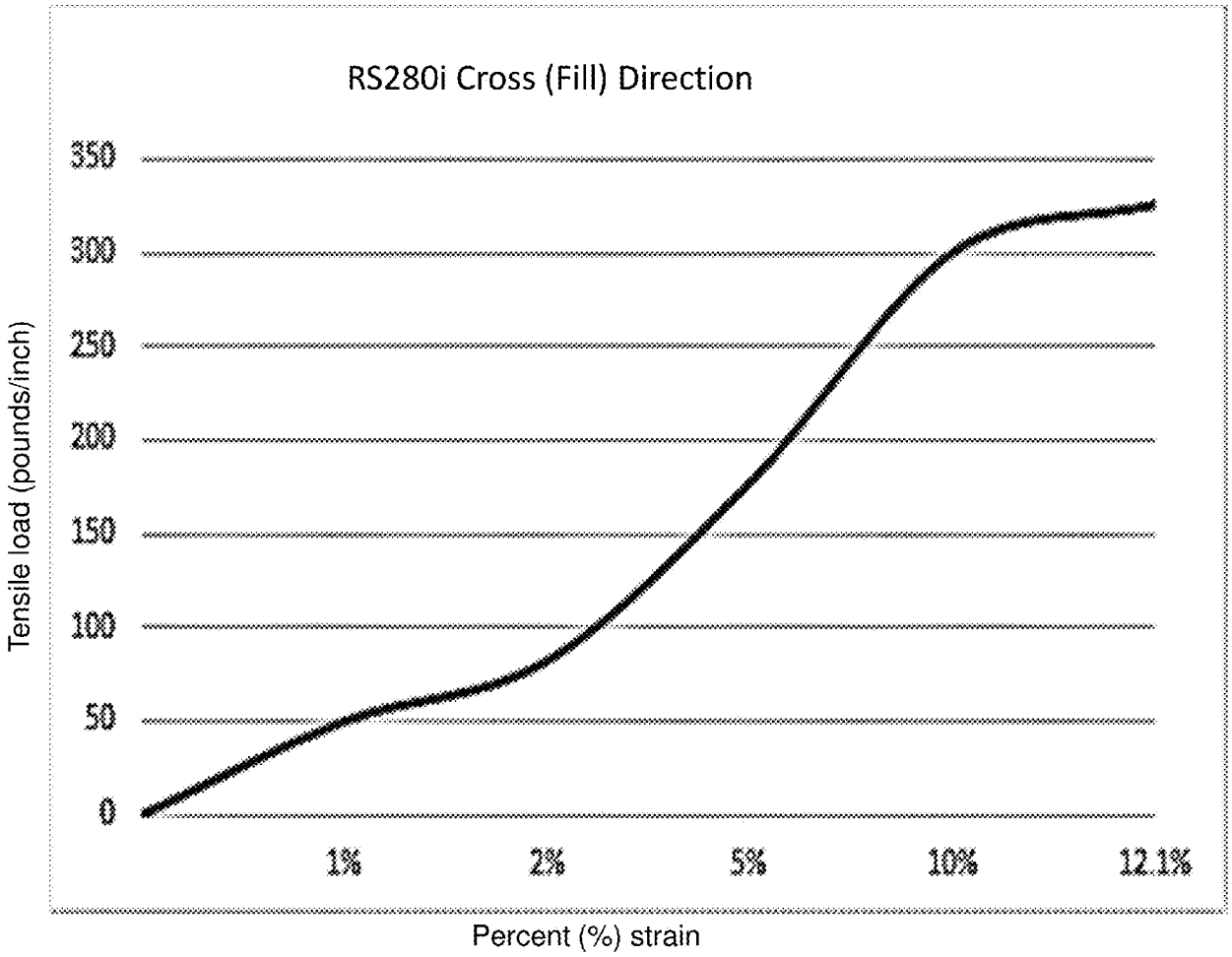
FIG. 10 is a graph showing tensile load (pounds/inch) in the cross (fill) direction as a function of % strain for the RS280i fabric shown in FIG. 8.

FIG. 9 is an expanded graph of the RS280i fabric's MD (warp) tensile compared to % strain as shown in FIG. 8. For comparison, FIG. 10 shows the RS280i fabric's tensile load (lb/in) as a function of % strain in the cross (fill) direction. Tensile in the cross direction (CD) also was measured in accordance with ASTM Standard D4595.

In one aspect, the woven geotextile has a 2% strain at a tensile load of at least 40 lb/in in the MD (warp) direction and in the CD (fill) direction. In another aspect, the woven geotextile has a 5% strain at a tensile load of at least 120 lb/in in the warp direction and in the fill direction. Yet, in another aspect, the woven geotextile has a 10% strain at a tensile load of at least 300 lb/in in the warp direction and the fill direction.

Table 2 below provides the MD tensile values shown in FIG. 8, as well as cross-machine direction (XMD) values for the RS280i and FW404 fabrics. Table 2 also shows MD and XMD tensile values for a 1/6 plain six-pick weave fabric having 30×60 threads/inch, with warp yarns comprising a melt blended admixture of polypropylene and polyethylene (PE warp yarn). As shown by the MD values in Table 2, the inventive RS280i fabric and the PE warp yarn fabric are biaxial fabrics with increased load bearing capacity at lower strain rates compared to the FW404 fabric. Biaxial means the MD and XMD directions, or 0° and 90° directions, are substantially equivalent in load bearing capacity at the same respective strain rates. While the RS280i and the PE warp yarn fabrics have substantially similar MD and XMD tensile values at a given strain, the FW404 fabric has substantially different MD and XMD tensile values and is not biaxial (see Table 2). Further, Table 2 shows that the RS280i and the PE warp fabrics are substantially biaxial at a MD tensile of 12%, and the FW404 fabric is not biaxial with a MD tensile of 17%.

Furthermore, compared to the FW404 fabric, the inventive RS280i fabric and the PE warp yarn fabric demonstrate decreased elongation at each tensile load (see Table 2). Because the weave pattern is unchanged between the RS280i and FW404 fabrics, this result was unexpected. Although changing the fabric weave pattern can increase MD tensile, other properties of the fabric (i.e., AOS and water flow) also can be altered. However, in the case of the inventive RS280i fabric, the weave pattern is the same as the FW404 fabric. Unexpectedly, the RS280i fabric provided a biaxial fabric with improved MD tensile, while maintaining other fabric properties, including AOS and water flow. In particular, the inventive fabric is a substantially biaxial modulus fabric.

TABLE 2

MD and XMD tensile

| | RS280i | | PE WARP YARN | | FW404 | |
|---|---|---|---|---|---|---|
| | MD | XMD | MD | XMD | MD | XMD |
| Tensile at 2% Strain (lb/in) | 73 | 79 | 67 | 78 | 50 | 82 |
| Tensile at 5% Strain (lb/in) | 169 | 170 | 161 | 165 | 114 | 176 |
| Tensile at 10% Strain (lb/in) | 324 | 289 | 308 | 281 | 214 | 297 |
| Ultimate Tensile (lb/in) | 373 | 324 | 367 | 331 | 311 | 320 |
| Ultimate Elongation (%) | 12.4 | 12.9 | 12.8 | 13.6 | 17.0 | 12.0 |

As discussed in U.S. Pat. No. 5,735,640 to Meyer et al. ("Meyer et al."), which is incorporated herein in its entirety by reference, geotextiles are used to stabilize weak subgrades. Meyer et al. references and discuses design guidelines for geotextiles used for subgrade stabilization of unpaved and paved roads. A difference between unpaved and paved road design is the in-service performance requirements. Unpaved road design allows some rutting to occur over the life of the structure. However, a paving surface (concrete, asphalt, or asphalt on concrete) cannot be placed on a structure that yields or ruts under load since the surfaces would eventually crack and deteriorate. Such cracking and rutting can destroy the integrity of the pavement structure.

As discussed in Meyer et al., geosynthetic stabilization of a weak subgrade allows access of normal construction equipment for the remaining structural lifts. The stabilization lift thickness using a geosynthetic is determined as that for an unpaved road which will only be subjected to a limited number of construction equipment passes. The function of separation (of subgrade and aggregate) in permanent paved road construction is considered the same as mentioned for unpaved road construction. Subgrade stabilization is applicable to the condition of weak subgrades. A geosynthetic is placed directly on the weak subgrade and is used to separate the soft subgrade from the stone base course and to improve the ultimate load carrying capacity of the subgrade. Separation, reinforcement, and filtration of wet soils through the geosynthetic support are important geosynthetic functions.

Referring to FIG. 5, geotextile 10 according to present invention can be employed to form a reinforced civil structure 50, which may be a roadway, runway, right of way, building foundation, or any other substantially level, graded surface which is desired to be substantially flat, on a subgrade 52 formed at least partially of soil. The geotextile 10 is disposed on the subgrade 52 and a base course 54 is disposed on the geotextile 10. Typically, the base course comprises a granular material, aggregate material, or a combination of granular material and aggregate material. The geotextile 10 can be used on any desired surface, including those with substantial grades, or it can be used in embankments, behind retaining walls, or as otherwise desired where inexpensive earth retaining/reinforcement/stabilization material is needed.

The reinforced civil structure 50, optionally, can have a surface layer 56 disposed on the base course 54. The surface layer 56 can comprise a layer of concrete, a layer of asphalt, or a layer of concrete disposed on the base course 54 and a layer of asphalt disposed on the concrete layer.

Preparation of the reinforced civil structure 50 includes preparing the subgrade 52 (which comprises at least partially soil). For instance, the preparation can include grading, compaction to the maximum density possible and other treatment of subgrade 52. Then, in sites which contain soft subgrade (such as with a CBR less than 3.0), geotextile 10 according to the present invention can be placed on the subgrade 52 and overlaid with the base course 54 formed of base partially of gravel or aggregate base. Then, optionally, the surface layer 56 can be placed on the base course 54 as desired in conventional manner. The biaxial properties of geotextile 10 as shown in FIGS. 1-4 absorb tension both laterally and longitudinally in the reinforced civil structure 50. Additionally, the woven nature of geotextile 10, with its multiple openings and AOS of 40, along with the great numbers of fill yarns 22 and warp yarns 32, serves very efficiently and effectively to separate base course 54 in subgrade 52 in order to prevent undesired migration of gravel into the subgrade 52 and vice-versa.

In sites involving a firmer subgrade (such as those with CBR greater than 3.0) geotextile 10 can, according to present invention, be placed between the subgrade 52 and the base course 54, or in the base course 54. In the latter case, the subgrade 52 is prepared and a portion of base course 54 applied thereto. The geotextile 10 is then applied to the partial base course 54 and the remainder of base course 54 then applied. The surface layer 56, optionally, can be added to any of these reinforced civil structures 52.

During installation, adjacent sections of geotextile 10 can be stapled, stitched or otherwise easily attached to each other. Selvaging may be formed in conventional fashion as part of membrane 10 to assist in this fastening process.

DEFINITIONS

The terms "a" and "an" do not denote a limitation of quantity, but rather denote the presence of at least one of the referenced item.

The term "or" means "and/or."

Reference throughout the specification to "one aspect", "another aspect", "an aspect", and so forth, means that a particular element (e.g., feature, structure, and/or characteristic) described in connection with the aspect is included in at least one aspect described herein, and may or may not be present in other aspects. In addition, it is to be understood that the described elements may be combined in any suitable manner in the various aspects.

In general, the compositions or methods may alternatively comprise, consist of, or consist essentially of, any appropriate components or steps herein disclosed. The invention may additionally, or alternatively, be formulated so as to be devoid, or substantially free, of any components, materials, ingredients, adjuvants, or species, or steps used in the prior art compositions or that are otherwise not necessary to the achievement of the function and/or objectives of the present claims.

"Optional" or "optionally" means that the subsequently described event or circumstance may or may not occur, and that the description includes instances where the event occurs and instances where it does not.

The modifier "about" used in connection with a quantity is inclusive of the stated value and has the meaning dictated by the context (e.g., includes the degree of error associated with measurement of the particular quantity).

The endpoints of all ranges directed to the same component or property are inclusive of the endpoints, are independently combinable, and include all intermediate points and ranges.

The suffix "(s)" as used herein is intended to include both the singular and the plural of the term that it modifies, thereby including one or more of that term (e.g., the colorant(s) includes one or more colorants).

The terms "first," "second," and the like, "primary," "secondary," and the like, as used herein do not denote any order, quantity, or importance, but rather are used to distinguish one element from another.

The terms "front," "back," "bottom," and/or "top" are used herein, unless otherwise noted, merely for convenience of description, and are not limited to any one position or spatial orientation.

The term "combination" is inclusive of blends, mixtures, alloys, reaction products, and the like.

Unless defined otherwise, technical and scientific terms used herein have the same meaning as is commonly understood by one of skill in the art to which this invention belongs.

All cited patents, patent applications, and other references are incorporated herein by reference in their entirety. However, if a term in the present application contradicts or conflicts with a term in the incorporated reference, the term from the present application takes precedence over the conflicting term from the incorporated reference.

The term "earth reinforcement" refers to activities and products which increase tensile and/or shear strength of earth or particulate structures such as in retaining wall structures, steep grades, level grades, and other applications that compel tensile and/or shear strength enhancement of particulate substrate properties.

As used herein, the term "separation" means that the contamination of a stone base course by intermixing with a subgrade soil is substantially or completely prevented, thus preserving the structural integrity and drainage capacity of the base course.

"Fiber" means a material in which the length to diameter ratio is greater than about 10. Fiber is typically classified according to its diameter. Filament fiber is generally defined as having an individual fiber diameter greater than about 15 denier, usually greater than about 30 denier per filament. Fine denier fiber generally refers to a fiber having a diameter less than about 15 denier per filament. Micro denier fiber is generally defined as fiber having a diameter less than about 100 microns denier per filament.

"Filament fiber" or "monofilament fiber" means a continuous strand of material of indefinite (i.e., not predetermined) length.

"Meltspun fibers" are fibers formed by melting a thermoplastic polymer composition and then drawing the fiber in the melt to a diameter (or other cross-section shape) less than the diameter (or other cross-section shape) of the die.

"Spunbond fibers" are fibers formed by extruding a molten thermoplastic polymer composition as filaments through a plurality of fine, usually circular, die capillaries of a spinneret (not shown). The diameter of the extruded filaments is rapidly reduced, and then the filaments are deposited onto a collecting surface to form a web of randomly dispersed fibers with average diameters generally between about 7 and about 30 microns.

"Yarn" means a continuous length of twisted or otherwise entangled plurality of filaments (i.e. multifilament) which can be used in the manufacture of woven or knitted fabrics and other articles. Yarn can be covered or uncovered. Covered yarn is yarn at least partially wrapped within an outer covering of another fiber or material, for example, cotton or wool. As used herein, "yarn" in a broad sense includes films, tapes, monofilaments, and yarns.

While the invention has been described with reference to exemplary embodiments and aspects, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments and aspects described herein falling within the scope of the appended claims.

What is claimed is:

1. A woven geotextile comprising a plain six-pick weave fabric having an apparent opening size (AOS) of at least 40 as measured in accordance with American Society for Testing and Materials International (ASTM International) Standard D4751-12, a water flow rate of at least 35 gpm/ft$^2$ as measured in accordance with ASTM International Standard D4491-99a (Reapproved 2009), and a 12% strain at a tensile load of at least 300 lb/in as measured in accordance with ASTM International Standard D4595-11 in a warp direction.

2. The geotextile of claim 1, wherein fabric is a substantially biaxial modulus fabric.

3. The geotextile of claim 1, wherein the fabric comprises:

i. a plurality of fill sets extending in a fill direction, each fill set having six fill yarns positioned substantially side-by-side one another;

ii. a plurality of warp yarns extending in the warp direction and interweaving the plurality of fill sets; and iii. a plurality of openings dispersed across the fabric, each opening defined by a given fill set and two adjacent warp yarns respectively disposed on opposite sides of and interweaving the given fill set and the intersection of the two adjacent warp yarns.

4. The geotextile of claim 3, wherein the fabric is a 1/6 plain six-pick weave.

5. The geotextile of claim 3, wherein the openings are substantially triangularly-shaped.

6. The geotextile of claim 3, wherein the fill yarns comprise 565 denier, round polypropylene monofilaments.

7. The geotextile of claim 3, wherein the warp yarns comprise monofilaments comprising an admixture of polypropylene and a polypropylene/ethylene copolymer and having a tenacity of at least 0.75 g/denier at 1% strain, at least 1.5 g/denier at 2% strain, and at least 3.75 g/denier at 5% strain.

8. The geotextile of claim 7, wherein the fill yarns comprise round polypropylene monofilaments.

9. The geotextile of claim 3, wherein the fill yarns of the respective fill sets are substantially aligned in the same plane.

10. The geotextile of claim 3, wherein the fabric is a 2/6 plain six-pick weave.

11. The geotextile of claim 10, wherein the plurality of warp yarns are disposed as warp sets and each warp set has two warp yarns positioned substantially side-by-side; and each opening being defined by a given fill set and two adjacent warp sets respectively disposed on opposite sides of and interweaving the given fill set and the intersection of the two adjacent warp sets.

12. The geotextile of claim 1, wherein the fabric has a water flow rate of at least 40 gpm/ft$^2$.

13. The geotextile of claim 1, wherein the fabric has a water flow rate of at least 45 gpm/ft$^2$.

14. The geotextile of claim 1, wherein the fabric has a water flow rate of at least 50 gpm/ft$^2$.

15. The geotextile of claim 1, wherein the fabric has a water flow rate of at least 55 gpm/ft$^2$.

16. The geotextile of claim 1, wherein the fabric has a water flow rate of at least 60 gpm/ft$^2$.

17. The geotextile of claim 1, wherein the fabric has a water flow rate of at least 65 gpm/ft$^2$.

18. The geotextile of claim 1, wherein the fabric has a water flow rate of at least 70 gpm/ft$^2$.

19. The geotextile of claim 1, wherein the fabric has a 12% strain at a tensile load of at least 310 lb/in in the warp direction.

20. The geotextile of claim 1, wherein the fabric has a 12% strain at a tensile load of at least 320 lb/in in the warp direction.

21. The geotextile of claim 1, wherein the fabric has a 12% strain at a tensile load of at least 325 lb/in in the warp direction.

22. The geotextile of claim 1, wherein the fabric has a 12% strain at a tensile load of at least 330 lb/in in the warp direction.

23. The geotextile of claim 1, wherein the fabric has a 12% strain at a tensile load of at least 340 lb/in in the warp direction.

24. The geotextile of claim 1, wherein the fabric has a 12% strain at a tensile load of at least 345 lb/in in the warp direction.

25. The geotextile of claim 1, wherein the fabric has a 12% strain at a tensile load of at least 350 lb/in in the warp direction.

26. The geotextile of claim 1, wherein the fabric has a 12% strain at a tensile load of at least 270 lb/in in a fill direction.

27. The geotextile of claim 1, wherein the fabric has a 12% strain at a tensile load of at least 280 lb/in in a fill direction.

28. The geotextile of claim 1, wherein the fabric has a 12% strain at a tensile load of at least 290 lb/in in a fill direction.

29. The geotextile of claim 1, wherein the fabric has a 12% strain at a tensile load of at least 300 lb/in in a fill direction.

30. The geotextile of claim 1, wherein the fabric has a 12% strain at a tensile load of at least 310 lb/in in a fill direction.

31. The geotextile of claim 1, wherein the fabric has a 12% strain at a tensile load of at least 320 lb/in in a fill direction.

32. The geotextile of claim 1, wherein the fabric has a 12% strain at a tensile load of at least 340 lb/in in a fill direction.

33. The geotextile of claim 1, wherein the fabric has a 12% strain at a tensile load of at least 350 lb/in in a fill direction.

34. A reinforced civil structure, comprising:

a. a subgrade formed at least partially of soil;

b. a base course formed at least partially of a granular material, aggregate material, or a combination thereof; and c. a woven geotextile as claimed in claim 1 disposed between the subgrade and the base course.

35. The civil structure of claim 34, further comprising a surface layer disposed on the base course.

36. The civil structure of claim 35, wherein the surface layer comprises concrete.

37. The civil structure of claim 35, wherein the surface layer comprises asphalt.

38. The civil structure of claim 35, further comprising a concrete layer disposed on the base course and an asphalt layer disposed on the concrete layer.

39. A reinforced civil structure, comprising:

a. a subgrade formed at least partially of soil;

b. a base course formed at least partially of a granular material, aggregate material, or a combination thereof; and c. a woven geotextile disposed between the subgrade and the base course, the geotextile comprising a plain six-pick weave fabric having an AOS of at least 40 as measured in accordance with ASTM International Standard D4751-12, a water flow rate of at least 35 gpm/ft$^2$ as measured in accordance with ASTM International Standard D4491-99a (Reapproved 2009), and a 12% strain at a tensile load of at least 300 lb/in in a warp direction as measured in accordance with ASTM International Standard D4595-11.

40. The civil structure of claim 39, wherein the fabric comprises:

i. a plurality of fill sets extending in a fill direction, each fill set having six fill yarns positioned substantially side-by-side one another;

ii. a plurality of warp yarns extending in a warp direction and interweaving the plurality of fill sets; and iii. a plurality of openings dispersed across the fabric, each opening defined by a given fill set and two adjacent warp yarns respectively disposed on opposite sides of and interweaving the given fill set and the intersection of the two adjacent warp yarns.

41. The civil structure of claim 40, wherein the fabric is a 1/6 plain six-pick weave.

42. The civil structure of claim 40, wherein the openings are substantially triangularly-shaped.

43. The civil structure of claim 40, wherein the fill yarns comprise round polypropylene monofilaments.

44. The civil structure of claim 40, wherein the warp yarns comprise monofilaments comprising an admixture of polypropylene and a polypropylene/ethylene copolymer and having a tenacity of at least 0.75 g/denier at 1% strain, at least 1.5 g/denier at 2% strain, and at least 3.75 g/denier at 5% strain.

45. The civil structure of claim 44, wherein the fill yarns comprise round polypropylene monofilaments.

46. The civil structure of claim 39, wherein the fabric is a 2/6 plain six-pick weave.

47. The civil structure of claim 46, wherein the plurality of warp yarns are respectively disposed as warp sets and each warp set comprising two warp yarns positioned substantially side-by-side; and each opening being defined by a given fill set and two adjacent warp sets respectively disposed on opposite sides of and interweaving the given fill set and the intersection of the two adjacent warp sets.

48. The civil structure of claim 39, wherein the fabric has a water flow rate of at least 40 gpm/ft$^2$.

49. The civil structure of claim 39, wherein the fabric has a water flow rate of at least 45 gpm/ft$^2$.

50. The civil structure of claim 39, wherein the fabric has a water flow rate of at least 50 gpm/ft$^2$.

51. The civil structure of claim 39, wherein the fabric has a water flow rate of at least 55 gpm/ft$^2$.

52. The civil structure of claim 39, wherein the fabric has a water flow rate of at least 60 gpm/ft$^2$.

53. The civil structure of claim 39, wherein the fabric has a water flow rate of at least 65 gpm/ft$^2$.

54. The civil structure of claim 39, wherein the fabric has a water flow rate of at least 70 gpm/ft$^2$.

55. The civil structure of claim 39, wherein the fabric has a 12% strain at a tensile load of at least 310 lb/in in the warp direction.

56. The civil structure of claim 39, wherein the fabric has a 12% strain at a tensile load of at least 320 lb/in in the warp direction.

57. The civil structure of claim 39, wherein the fabric has a 12% strain at a tensile load of at least 325 lb/in in the warp direction.

58. The civil structure of claim 39, wherein the fabric has a 12% strain at a tensile load of at least 330 lb/in in the warp direction.

59. The civil structure of claim 39, wherein the fabric has a 12% strain at a tensile load of at least 340 lb/in in the warp direction.

60. The civil structure of claim 39, wherein the fabric has a 12% strain at a tensile load of at least 345 lb/in in the warp direction.

61. The civil structure of claim 39, wherein the fabric has a 12% strain at a tensile load of at least 350 lb/in in the warp direction.

62. The civil structure of claim 39, wherein the fabric has a 12% strain at a tensile load of at least 270 lb/in in a fill direction.

63. The civil structure of claim 39, wherein the fabric has a 12% strain at a tensile load of at least 280 lb/in in a fill direction.

64. The civil structure of claim 39, wherein the fabric has a 12% strain at a tensile load of at least 290 lb/in in a fill direction.

65. The civil structure of claim 39, wherein the fabric has a 12% strain at a tensile load of at least 300 lb/in in a fill direction.

66. The civil structure of claim 39, wherein the fabric has a 12% strain at a tensile load of at least 310 lb/in in a fill direction.

67. The civil structure of claim 39, wherein the fabric has a 12% strain at a tensile load of at least 320 lb/in in a fill direction.

68. The civil structure of claim 39, wherein the fabric has a 12% strain at a tensile load of at least 340 lb/in in the fill direction.

69. The civil structure of claim 39, wherein the fabric has a 12% strain at a tensile load of at least 350 lb/in in a fill direction.

70. The civil structure of claim 39, further comprising a surface layer disposed on the base course.

71. The civil structure of claim 70, wherein the surface layer comprises concrete.

72. The civil structure of claim 70, wherein the surface layer comprises asphalt.

73. The civil structure of claim 39, further comprising a concrete layer disposed on the base course and an asphalt layer disposed on the concrete layer.

74. The civil structure of claim 39, wherein fabric is a substantially biaxial modulus fabric.

75. The woven geotextile of claim 1, wherein the woven geotextile has a 2% strain at a tensile load of at least 40 lb/in in the warp direction and the fill direction.

76. The woven geotextile of claim 1, wherein the woven geotextile has a 5% strain at a tensile load of at least 120 lb/in in the warp direction and in the fill direction.

77. The woven geotextile of claim 1, wherein the woven geotextile has a 10% strain at a tensile load of at least 300 lb/in in the warp direction and the fill direction.

* * * * *